US007181994B2

(12) United States Patent
Norton

(10) Patent No.: US 7,181,994 B2
(45) Date of Patent: Feb. 27, 2007

(54) HANDLE SAVER

(76) Inventor: Michael D. Norton, 4825 Red Bluff St., Shasta Lake City, CA (US) 96019

( * ) Notice: Subject to any disclaimer, the term of this patent is extended or adjusted under 35 U.S.C. 154(b) by 0 days.

(21) Appl. No.: 11/126,724

(22) Filed: May 12, 2005

(65) Prior Publication Data

US 2006/0254391 A1 Nov. 16, 2006

(51) Int. Cl.
*B25D 1/00* (2006.01)

(52) U.S. Cl. ..... 81/22; 81/20
(58) Field of Classification Search ..... 81/22, 81/20
See application file for complete search history.

(56) References Cited

U.S. PATENT DOCUMENTS 2,980,154 A * 4/1961 Williamson ..... 81/20
4,172,483 A * 10/1979 Bereskin ..... 81/20
D258,413 S * 3/1981 Adams ..... D8/80

* cited by examiner

*Primary Examiner*—David B. Thomas
(74) *Attorney, Agent, or Firm*—Irving Keschner

(57) ABSTRACT

A striking implement, such as a maul, to reduce the impact force on the handle used with the member. The device is fabricated of metal and has two elongated parallel supports, a base, and a two angled end portions joining together one end of each parallel support, the interior of the device being hollow. Preferably, the device is formed integral with the head of the member, the handle extending through the device and being secured to the head member.

3 Claims, 1 Drawing Sheet

HANDLE SAVER

BACKGROUND OF THE INVENTION

1. Field of the Invention

The present invention provides a device for use with a striking implement, such as axes or large hammers, to absorb the impact when the head misses an object and the object instead strikes the handle.

2. Description of the Prior Art

Striking implements, such as axes comprising a head and handle, have been available for decades. Typically, the handle is made of oak wood and is secured directly to the axe head. If the head of the striking implement misses the object and the object instead strikes the handle, the handle may crack or break due to the vibratory forces applied thereto.

What is desired is to provide a simple, cost efficient device which, when attached to the head, increases the lifetime of the striking implement.

SUMMARY OF THE INVENTION

The present invention provides a device that is coupled to the head of a striking implement, such as an axe or sledge hammer, to absorb the force resulting when the head of the member misses an object thus preventing the handles from breaking or cracking.

The device is comprised of a metal piece and has two elongated supports, a base, and two angled end portions joining together one end of each support, the interior of the device being hollow. Preferably, the device is formed integral with the head of the member, the handle extending through the device and being secured to the head member.

DESCRIPTION OF THE DRAWINGS

For a better understanding of the present invention as well as other objects and further features thereof, reference is made to the following description which is to be read in conjunction with the accompanying drawing therein.

DESCRIPTION OF THE INVENTION

Figure 1:
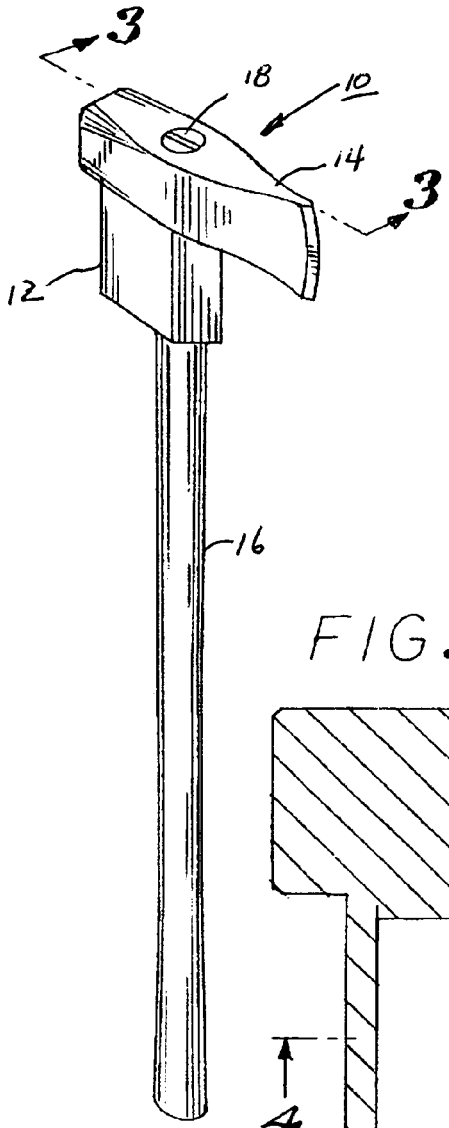
FIG. 1 is a perspective view of a maul using the handle saver of the present invention.
Figure 2:
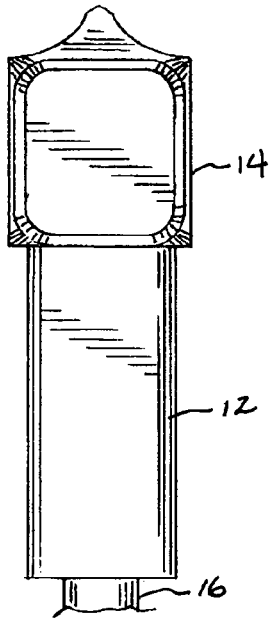
FIG. 2 is a rear view of the upper portion of the maul shown in FIG. 1.

FIG. 1 is a perspective view of a striking implement 10, such as a maul, incorporating the handle saver device 12 of the present invention. Member 10 further includes a head member 14 and handle 16. In the preferred embodiment, device 12 and head member 14 are cast from rolled and tempered steel as an integral unit. Handle 16 is typically made of wood or fiberglass. FIG. 2 is a rear view of the upper portion of member 10 and FIG. 3 is a cross-sectional view along line 3—3 of FIG. 1 showing maul head 14 and handle 16, driving wedge 18 securing maul head 14 to handle 16.

Figure 3:
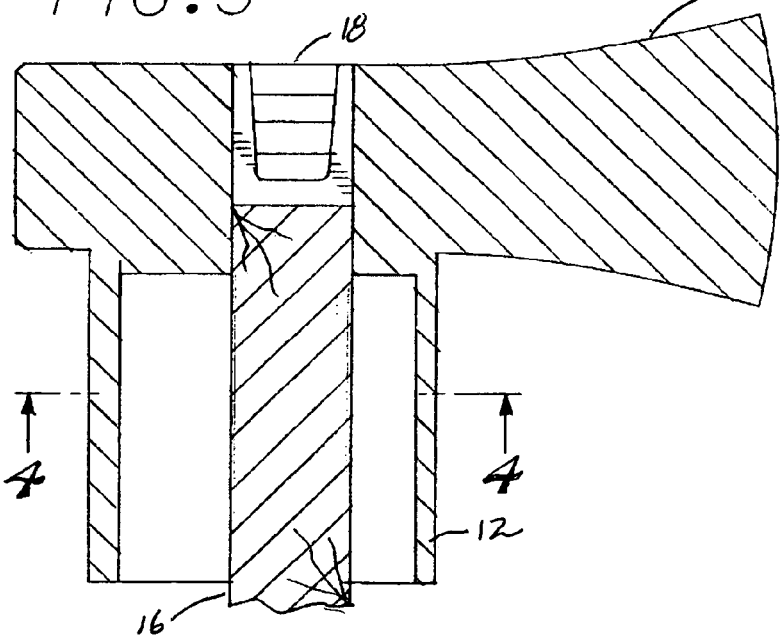
FIG. 3 is a cross-sectional view along line 3—3 of FIG. 1.
Figure 4:
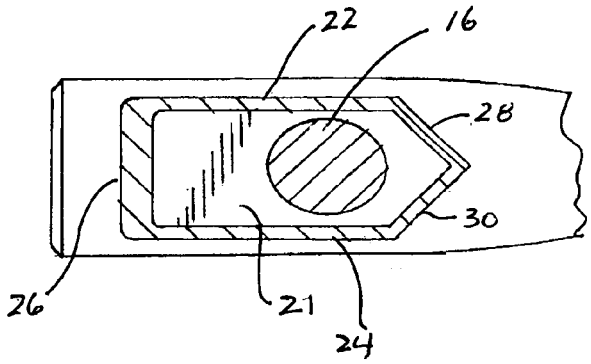
FIG. 4 is a cross-sectional view along line 4—4 of FIG. 3.

FIG. 4 is a cross-sectional view along line 4—4 of FIG. 3 and illustrates device 12 as having a hollow inner portion 21 for receiving handle 16. In the embodiment illustrated, device 12 comprises parallel supports 22 and 24, base portion 26 and angled top, or front, portions 28 and 30.

Device 12 can be used with striking implements, such as doubled bitted axes, single bit axes, splitting mauls and sledge hammers of varying sizes and any other similar device. The device 12 typically weighs 2.5 pounds although the weight will depend on the dimensions of the force impacting member The shape of device 12 is similar to the shape of the head of the striking implement. Device 12 keeps the handle free of gouges, splits and chips and also saves the handle in case of a direct miss. Device 12 preferably is cast as part of the head member as an integral unit although it could be welded or otherwise attached to the head member.

The device of the present invention thus provides a simple and cost effective way for minimizing the force of the impact caused by the handle of a striking implement striking an object, which in turn prevents the handle from breaking.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A striking implement comprising:

a head member;

a handle; and a device integral with said head member for minimizing the force impacting said handle as said handle strikes an object, said device interposed between said head member and said handle and having a hollow recess area, said device comprising first and second parallel support members, a base portion coupled to one end of said first and second support members, and first and second angled front portions coupled to a second end of said first and second support members.

2. The implement of claim 1, wherein said head member comprises first and second side portions and a base portion, each having an end extending at an angle, the front portions of said device having an angle which corresponds to the angle of said first and second side portions of said head member.

3. The implement of claim 2 wherein said base portion of said device has a shape which corresponds to the shape of the base portion of said head member.

* * * * *